US011035231B2

(12) United States Patent
Yuratich et al.

(10) Patent No.: US 11,035,231 B2
(45) Date of Patent: Jun. 15, 2021

(54) APPARATUS AND METHODS FOR TOOLS FOR COLLECTING HIGH QUALITY RESERVOIR SAMPLES

(71) Applicant: Fiorentini USA Inc, Wheeling, WV (US)

(72) Inventors: Michael Yuratich, Hamble (GB); Philip Powell, New Alresford (GB); Margaret Waid, Houston, TX (US); Mohamed Hashem, Houston, TX (US); Paolo Nardi, Milan (IT)

(73) Assignee: Fiorentini USA Inc., Wheeling, WV (US)

( * ) Notice: Subject to any disclaimer, the term of this patent is extended or adjusted under 35 U.S.C. 154(b) by 117 days.

(21) Appl. No.: 16/457,991

(22) Filed: Jun. 29, 2019

(65) Prior Publication Data

US 2020/0003054 A1 Jan. 2, 2020

Related U.S. Application Data

(60) Provisional application No. 62/692,801, filed on Jul. 1, 2018.

(51) Int. Cl.

| | |
|---|---|
| ***E21B 49/10*** | (2006.01) |
| ***E21B 49/08*** | (2006.01) |
| ***E21B 49/00*** | (2006.01) |

(52) U.S. Cl.

CPC ..... *E21B 49/10* (2013.01); *E21B 49/00* (2013.01); *E21B 49/08* (2013.01); *E21B 49/081* (2013.01); *E21B 49/0875* (2020.05)

(58) Field of Classification Search

CPC ..... E21B 49/10; E21B 49/081; E21B 49/00; E21B 49/08; E21B 49/0875

See application file for complete search history.

(56) References Cited

U.S. PATENT DOCUMENTS

| | | | | |
|---|---|---|---|---|
| 6,301,959 | B1 * | 10/2001 | Hrametz | E21B 49/10 73/152.23 |
| 6,688,390 | B2 * | 2/2004 | Bolze | E21B 49/081 166/264 |
| 7,757,551 | B2 * | 7/2010 | Meister | E21B 49/10 73/152.26 |
| 7,913,774 | B2 * | 3/2011 | Partouche | E21B 49/10 175/48 |
| 9,284,838 | B2 * | 3/2016 | Cernosek | E21B 49/10 |
| 9,988,902 | B2 * | 6/2018 | Proett | E21B 49/10 |

FOREIGN PATENT DOCUMENTS

| | | | | |
|---|---|---|---|---|
| WO | WO 2918294211 | * | 8/2018 | E21B 49/10 |

* cited by examiner

*Primary Examiner* — Yong-Suk (Philip) Ro

(74) *Attorney, Agent, or Firm* — Matthew J Patterson

(57) ABSTRACT

Methods and systems for collecting high quality reservoir samples and determining producibility of those samples are disclosed that provide for a non-stop and no shock sampling process. The systems and methods of the present disclosure are especially important collecting samples of reservoir samples in a manner that most closely resembles production fluids and maintains the reservoir at or near the draw down pressure during the pumping and sampling processes.

22 Claims, 9 Drawing Sheets

APPARATUS AND METHODS FOR TOOLS FOR COLLECTING HIGH QUALITY RESERVOIR SAMPLES

BACKGROUND OF THE DISCLOSURE

Field of the Invention

Embodiments of the disclosure generally relate to tools and techniques for performing formation testing and, more particularly, to a novel formation sampling apparatus and method.

Description of the Related Art

Wireline formation testing tools are well known in the prior art in providing permeability, mobility, sampling and other information that can be inferenced therefrom about the reservoir.

In oil and gas exploration, a primary goal of a wireline testing tool is to obtain fluid samples from earth formations representative of the reservoir. These samples are examined in special laboratories for purposes, such as to discover their physical composition.

Obtaining samples is commonly achieved by the use of special tools that are run into boreholes. A tool is sealed to the formation at a predetermined station of interest, and has an internal conduit hydraulically coupled to a pump. The tool can comprise a probe having a packer that seals against the wellbore wall and surrounds a snorkel through which fluids flow. The tool can also comprise a straddle packer type tool having a pair of inflatable packers positioned a distance apart from each other that seal off a portion of the borehole and the fluids are drawn in through the tool between the straddle packers. The pump is used to lower the pressure in the conduit until fluid is induced to flow from the formation wherein such pressure is referred to as the draw down pressure. The fluid is drawn into the tool and typically initially discharged to the well bore. Monitoring devices are used to ascertain the quality of the fluid that is being pumped, until at some point the fluid is transferred to a sampling receptacle, sometimes referred to as a "bottle". The bottle is sealed, then recovered to surface. At surface it may be transported directly to a laboratory or transferred to another bottle better suited to transportation. A small amount of fluid may first be withdrawn for immediate, but preliminary, assessment.

The nature of well bore management is that it is filled with special fluids, commonly called 'mud'. This fluid is a mixture of chemicals, solids and oil or water. The mud is designed to maintain a pressure gradient such that at any depth in the borehole, the mud fluid pressure exceeds that of the reservoir. This prevents collapse of the well bore, and prevents uncontrolled production of reservoir fluids to surface. The fluid has additional properties such as preventing chemical destabilization of the formation material.

The excess pressure of the well bore fluid over the reservoir fluid causes permeation of the former into the formation immediately surrounding the well bore. This permeation of the well bore fluids into the formation is known as invasion, and the fluid that enters the formation is known as invasion filtrate. Solid particles in the well bore fluid are unable to permeate into the formation and are left behind on the well bore surface. Over time these particles build up a thickness which itself becomes sensibly impermeable to fluid, and the invasion process ceases. The layer of particles is referred to as filter cake or mud cake.

During the pumping of formation fluids, it is readily apparent to those skilled in the art that when pumping of the fluid first commences the fluid will be invasion filtrate, followed by an increasing proportion of representative reservoir fluid. The fluid within the reservoir generally flows in streamlines. Removed from the sampling point, the flow pattern progressively changes shape, for example from omnidirectional radially converging flow ("spherical") to flow perpendicular to the borehole but radially converging ("cylindrical"). Eventually there is a direct stream of reservoir fluid entering the sampling conduit, and the fluid boundary between invasion filtrate and reservoir fluid may, for example, be conical around the sampling point. The particular flow pattern is not significant here other than that it exists.

When pumping, the pressure at the probe will be less than the reservoir pressure by an amount known as the reservoir drawdown pressure. Many times, prior art sampling tools fail to maintain a steady drawdown pressure and as a result "shock" the formation by transmitting pressure gradients into the formation. When the formation is shocked during the sampling process, as in the case where there is an interruption to the flow, then the flow pattern rapidly changes. When flow resumes, it takes time for the pattern to return to its condition prior to the interruption. This results in a period of renewed contamination, and also a change in reservoir state, such as the deposition of particles or fluid constituents within the pore space that may affect the representativeness of subsequently pumped fluids.

Asphaltenes are an example of a constituent present in almost all crude oils. These carbon solids have a propensity to aggregate (flocculate) and deposit from the fluid, causing irreversible changes in fluid characteristics, mobility through the formation, and, in subsequent production operations, can block pipelines and hinder refining. It is important to sample carefully without shocks to the fluid in the formation in order to obtain a representative sample, and to maintain the acquired sample above the critical pressure at which aggregation starts.

It is also important to note that in the nature of complex formation exploration tools, that failures occur when the tools are in the borehole. Therefore, the cost of providing exploration services and the value of the formation samples are both high. A typical operational strategy might be to take a first sample as soon as contamination has been reduced significantly, to reduce exposure to failure. It is desirable to be able to take additional samples as soon as possible, but these should be high quality as the number of samples that can be taken in a single run of the formation tool in the hole is limited.

Even when representative reservoir fluid enters the sampling conduit of the formation tool, the sample can be altered or damaged by the tool itself. For example, the sour gas (such as $H_2S$) content of the fluid is immensely important to assessing a reservoir since it determines, among other things, the price of the crude and whether very large capital expenditures will be needed in production plant to accommodate and remove this poisonous and corroding gas. However, many commonly used materials in downhole tools readily absorb this gas. Examples of these materials includes elastomers, lubricating and hydraulic oils, and certain metals. During sampling it is desirable to minimize exposure to these materials both in surface contact area and in residence time.

Another consideration in the use of formation testing tools is that almost all oil reservoirs include a significant amount of dissolved gas. This gas may have many components.

When the fluid pressure is reduced below the bubble-point pressure of any of the gas components, such as while being pumped into a formation testing tool or sample container, the gas will come out of solution. It is known to be very difficult, if not impossible, to make this gas go back into solution to restore the initial composition. Therefore, an important requirement of reservoir fluid sampling tools is to be configured to sample at pressures above the bubble point pressure, and to maintain the sampled fluid above the bubble point pressure throughout its journey from the reservoir to the laboratory. This means that pressure drops within the tool sampling conduit and within the pump as well as within the sample container must be minimized. Once extracted from the formation the sample cools, and therefore shrinks in volume, during its return to surface and can cool further during transportation depending on season and geographical transit. If the sampling receptacle has a fixed volume, shrinkage will be accompanied by a reduction in pressure, and almost always results in some gas components coming out of solution. To avoid this reduction in pressure, methods of maintaining pressure have been developed in the prior art. The methods in current practice generally entail using pressurized nitrogen bearing on the fluid sample via some sort of freely moving barrier within the sample container. The design premise behind these methods is that the nitrogen expands to fill the space left by sample fluid shrinkage, but that as a gas, its pressure does not drop dramatically with temperature, and its pressure remains above the sample bubble point pressure. In this way the nitrogen acts as a spring and urges the freely moving barrier against the sample to maintain pressure above the bubble point.

Another consideration in the use of formation tools is the consequence of prolonged residence time within the tool between the time the reservoir fluid enters the sampling conduit and the time when the reservoir fluid enters the sampling receptacle. If the time is too long, the components of the sample can separate. The residence time can be prolonged by the nature of the tool design or by the reservoir characteristics. In the latter case, a low permeability formation may only permit a low sampling flow rate, as a higher rate would drop the sampling pressure to below the fluid bubble point. A low sampling rate necessarily results in a longer residence time. It is desirable therefore to minimize the physical volume of the conduit and, in most prior art formation tools, the pump displacement, to reduce the separation of the sample components. Filling a receptacle with a fluid of stratified components will result in a mixture that is unrepresentative of the formation. Moreover, the component fractions may differ from the original fluid due to different transit times and traps within the tool.

A further consequence of a complex fluid path between the formation and the receptacle is that contamination can occur from residues of samples taken earlier in the process, including from a previous station.

There are several patents in the prior art directed at sample receptacles that attempt to maintain samples at reservoir conditions. One such patent is U.S. Pat. No. 6,688,390 which comprises a cylinder having two pistons separating the bottle into three chambers. Samples are run through the main pump and injected into one end of the bottle. A middle chamber is filled with a buffer fluid and the other end of the bottle contains a gas. The pressure of the gas is regulated to exert pressure onto the buffer fluid and in turn onto the sample. Other such patents include U.S. Pat. Nos. 7,246,664 and 7,191,672 both of which disclose a bottle which comprises a cylinder having two pistons separating the bottle into three chambers. In a similar manner to the U.S. Pat. No. 6,688,390, sample fluids are run through the main pump and injected into one end of the bottle. The middle chamber is filled with a gas fluid and the other end of the bottle is filled with wellbore fluid. Both of these latter patents disclose a method of filling the bottle through the middle chamber through a valve located in one of the pistons.

It is therefore an object of the present invention to have a method and apparatus for obtaining formation fluid samples that will minimize operation time, reduce the complexity and volume of the those parts of the tool in contact with the fluid prior to the sample container, not disturb the formation throughout the sample taking at a given station and will maintain the fluid above its bubble and asphaltene points throughout its journey from reservoir to laboratory. It is a further objective to maximize reliability and minimize cost by implementing a novel sample container.

SUMMARY OF THE DISCLOSURE

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a tool configured to sample a formation fluid from a reservoir that includes a reservoir flowline configured to be in fluid communication with a portion of the reservoir, a main pump in fluid communication with the reservoir flowline, a sample container in fluid communication with the reservoir flowline, a sampling pump hydraulically coupled to the sample container and configured to transfer a buffer fluid in and out of the sample container, and a power and processing unit configured to control the main pump and the sampling pump to maintain the reservoir approximately at a drawdown pressure.

Implementations may include one or more of the following features. The tool where the sample container includes a housing having at least two pistons slidably disposed therein and dividing the housing into at least three chambers, each of the at least three chambers having a variable volume, including an intermediate chamber, a first end chamber and a second end chamber, the intermediate chamber defined by the pistons and where the pistons are free of valves, a first conduit configured to pressurize the intermediate chamber with a gas, a second conduit coupled to the first end chamber and the reservoir flowline, and a third conduit coupled to the second end chamber and the sampling pump. The tool further including a packer, the packer includes of one of a donut packer and a straddle packer. The tool further including a probe assembly, the probe assembly including: a snorkel coupled to the reservoir flowline and configured to penetrate at least partially into the portion of the reservoir. The tool further including a buffer fluid tank coupled to the sampling pump.

One general aspect includes a method of sampling a formation fluid from a reservoir including positioning a reservoir flowline in fluid communication with a portion of the reservoir located below a surface, coupling a main pump to the reservoir flowline, coupling a sample container to the reservoir flowline and to a sampling pump, the sample container having a buffer chamber and a sample chamber, pumping the formation fluid continuously with the main pump until the formation fluid is substantially free of filtrate, splitting the formation fluid into a first portion and a second portion, pumping the first portion with the main pump, pumping a buffer fluid out of the buffer chamber with the sample pump, and drawing the second portion of the formation fluid into the sample chamber. Other embodiments of this aspect include corresponding computer systems, apparatus, and computer programs recorded on one or more computer storage devices, each configured to perform the actions of the methods.

Implementations may include one or more of the following features. The method further including continuously controlling the main pump and the sample pump to maintain the reservoir approximately at a reservoir drawdown pressure. The method where the sample container further includes a pressure chamber positioned between the buffer chamber and the sample chamber, the method further including pressurizing the pressure chamber to a predetermined initial pressure. The method further including: continuously pumping the formation fluid with the main pump, uncoupling the sample container from the reservoir flowline and the sampling pump, and coupling a subsequent sample container to the reservoir flowline and to the sampling pump. Implementations of the described techniques may include hardware, a method or process, or computer software on a computer-accessible medium.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method of sampling a formation fluid from a reservoir including providing a first sample container and a second sample container each including. The method also includes dividing a housing into at least three chambers, each of the at least three chambers having a variable volume, including an intermediate chamber, a first end chamber and a second end chamber. The method also includes pressurizing the intermediate chamber with a gas. The method also includes pumping the formation fluid continuously with a main pump until the formation fluid is substantially free of filtrate. The method also includes coupling the second end chamber of the first sample container to a sampling pump. The method also includes simultaneously pumping a first portion of the formation fluid with the main pump and transferring a buffer fluid out of the second end chamber of the first sample container using the sampling pump. The method also includes drawing a second portion of the formation fluid into the first end chamber of the first sample container until the first end chamber of the first sample container is full of formation fluid. The method also includes sealing the first end chamber of the first sample container and the second end chamber of the first sample container. The method also includes pumping the formation fluid continuously with the main pump. The method also includes uncoupling the first sample container. The method also includes coupling the second end chamber of the second sample container to a sampling pump. The method also includes simultaneously pumping a third portion of the formation fluid with the main pump and transferring a buffer fluid out of the second end chamber of the second sample container using the sampling pump. The method also includes drawing a fourth portion of the formation fluid into the first end chamber of the second sample container until the first end chamber of the second sample container is full of formation fluid. The method also includes sealing the first end chamber of the second sample container and the second end chamber of the second sample container. Other embodiments of this aspect include corresponding computer systems, apparatus, and computer programs recorded on one or more computer storage devices, each configured to perform the actions of the methods.

Implementations may include one or more of the following features. The method further including continuously maintaining the reservoir at a reservoir drawdown pressure. Implementations of the described techniques may include hardware, a method or process, or computer software on a computer-accessible medium.

BRIEF DESCRIPTION OF THE DRAWINGS

So that the manner in which the above recited features of the present disclosure can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present disclosure is directed at a formation dynamic testing (FDT) tool which includes a probe and sample collection system for collecting high quality reservoir samples. The collection sample system includes sample receptacles positioned in close proximity to the probe. Embodiments of the present disclosure may comprise a wireline deployed formation tester or a logging while drilling (LWD) or measurement while drilling (MWD) tool having the ability to dynamically flow fluids from the reservoir while producing information about the reservoir fluids and their production.

Examples of Tools for Collecting High Quality Reservoir Samples

Figure 1:
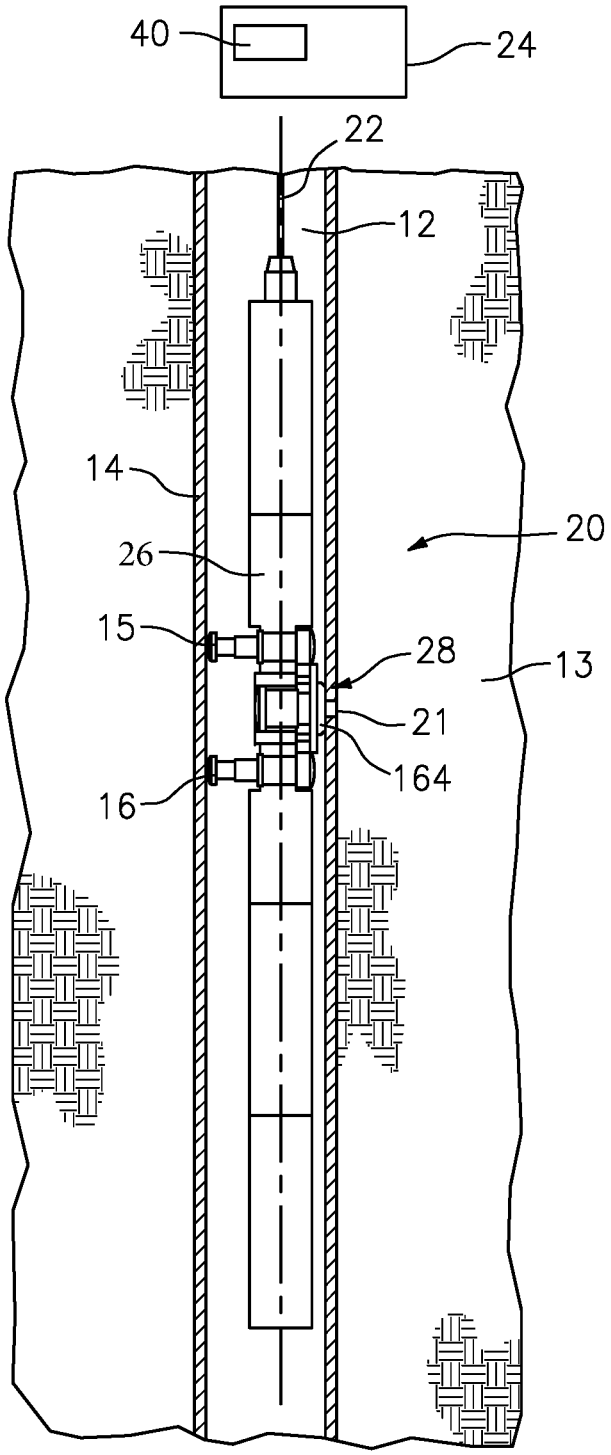
FIG. 1 illustrates a high level schematic representation of the use of a formation tester, including a sample collection module in accordance with certain aspects of the present disclosure.

With reference to FIG. 1 there is shown an embodiment of a wireline formation tester 20 deployed within a well 12 drilled into formation 13. In operation, the wireline formation tester 20 is deployed into well 12 via wireline cable 22 over pulley 16. As is well known in the art, wireline cable 22 includes electrical conductors for powering the tool, data communications conductors as well as tensile members for supporting the weight of the testing tool. The borehole typically contains various mixtures of fluids and gasses wherein the mixture varies by depth, age of the well and various other factors. The well is shown as an open hole however, the present disclosure is not limited to open hole wells and could, for instance, be used within a cased hole well.

FIG. 1 illustrates an embodiment of the formation testing tool 20 wherein the tool is shown deployed in borehole 14 and includes various modules as will be described in more detail herein below. The multi-conductor cable 22 carries electrical power and data to and from processing unit 24 located at the surface. The power and processing unit 24 is configured to control the various modules, pumps, valves and other components included in the formation testing tool 20. In addition, power and processing module 24 includes a processor 40, in the form of a computer and the like, for processing the electrical signals from the formation testing tool into information concerning the analysis and characterization of the downhole fluids, and usually includes a storage medium 42. In this particular embodiment, the formation tester 20 includes a clamping mechanism comprised of pistons 15, 16 that is urged against the borehole wall by the pistons to stabilize the formation tester within the wellbore 14. The formation tester includes a probe assembly 28 having a mechanism to urge the probe pad 164 against borehole wall with sufficient force to releasably fix the formation tester in place. The probe pad further seals the formation 13 from the wellbore 14 in the area of contact. The probe assembly 28 can, at least partially, penetrate the borehole wall and any mud cake that may exist adjacent thereto and enters into fluid communication with the formation area 13. As will be described in greater detail herein below, the probe 28 is in hydraulic communication with a pump mounted within the formation tester housing 26. The probe assembly may also include a guard ring (not shown) and which may comprise a loop that encircles the ring and is hydraulically coupled to a pump mounted within the formation tester housing 26. An exemplary embodiment of a focused guard probe is disclosed in U.S. Pat. No. 6,301,959 (959) to Hrametz, the disclosure of which is included herein in its entirety.

Figure 2:
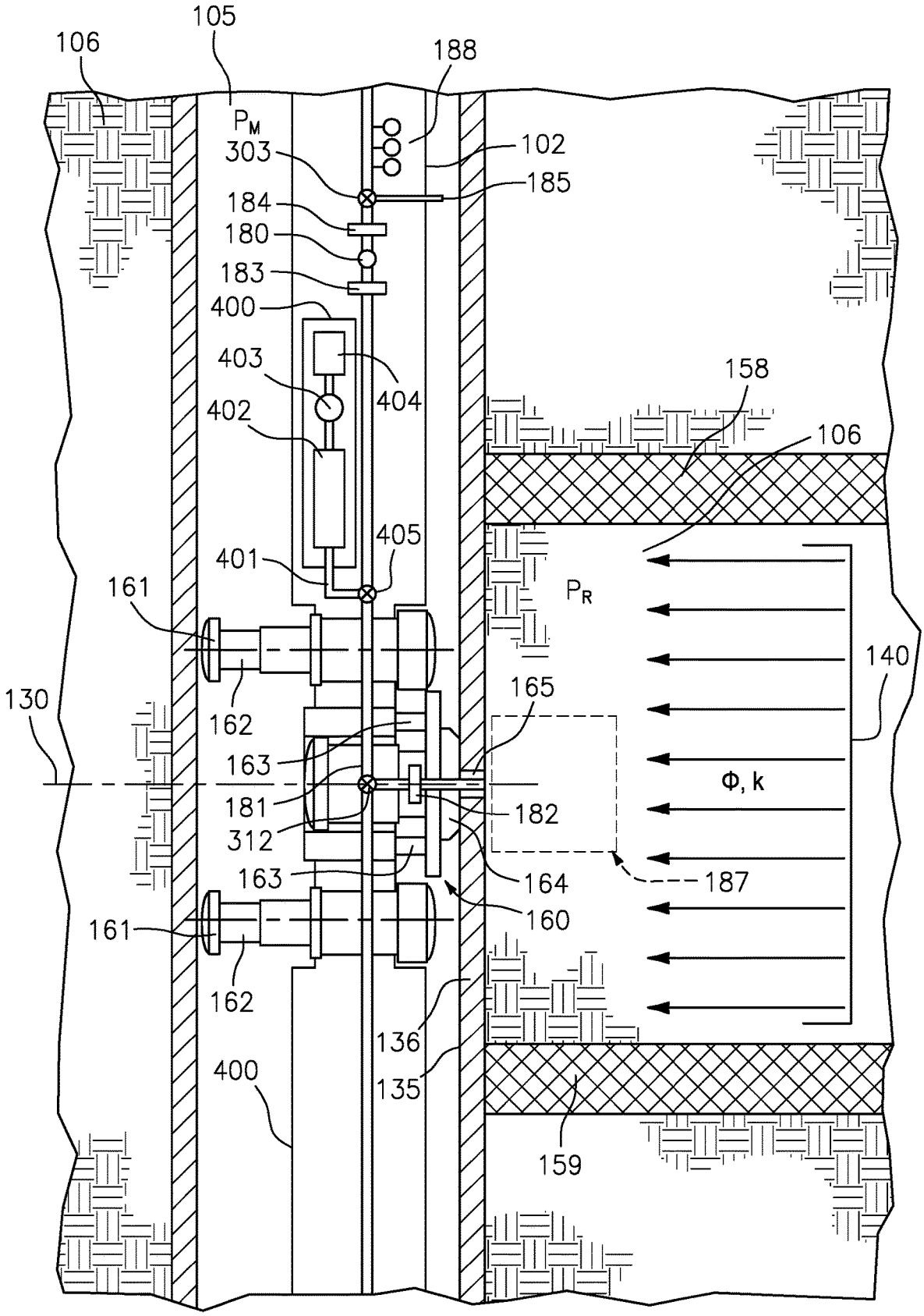
FIG. 2 illustrates a formation tester, including a sample collection module of a sample collection system in accordance with certain aspects of the present disclosure.

With reference to FIG. 2 there is shown an embodiment of a wireline formation tester 102 deployed within a well 105 drilled into formation 106 having a porosity 1 and a permeability k. The well is shown as an open hole however, the present disclosure is not limited to open hole wells and could, for instance, be used within a cased hole well with proper additions made thereto to penetrate the casing. In this particular embodiment, the formation tester 102 includes a clamping mechanism 161 that is urged against the borehole wall 135 by pistons 162 with shoes to stabilize the formation tester within the wellbore 105. The formation tester includes a probe assembly 160 having a pair of pistons 163 to urge the probe pad (or donut packer) 164 against borehole wall 135 with sufficient force to releasably fix the formation tester in place. The probe and the pistons with shoes are three points that can determine a plane so that the formation tool does not rotate or wobble in the preselected downhole position. The probe pad 164 further seals the formation 106 from the wellbore 105 in the area of contact. The probe 165 penetrate at least a portion of the borehole wall 135 and any mudcake that may exist adjacent thereto and enters into fluid communication with the formation area 106. The probe 165 is in hydraulic communication with main pump 180 mounted within the formation tester housing 102. The probe assembly may also include a guard ring (not shown) as which may comprise a loop that encircles the ring and is hydraulically coupled to main pump 180 mounted within the formation tester housing 102. Although the present disclosure is described with reference to an embodiment having a donut packer and probe, it is within the scope of the present disclosure that embodiments can include any type of sampling tool including straddle packer tools. Still referring to FIG. 2, there is illustrated the presence of directional streamlines of formation fluid 140 that are established as pumping occurs through probe 165 occurs first for clean-up and afterwards for sampling as will be described in more detail herein after. Although streamlines 140 are shown as being horizontal in nature, it should be appreciated by those skilled in the art that, in certain embodiments of the present disclosure, the streamlines may form a cone shape within testing volume 187 and the cone can persist for long periods of time using the non-stop, no shock methods described herein. Such non-stop, no shock methods can inventively be practiced using tools disclosed herein wherein main pump 180 is run continuously during the clean-up and sampling processes and the operation of sample pump 403 is controlled cooperatively with the main pump during the sample process to keep the reservoir pressure at or near the drawn pressure.

It is known in the art to provide a wellbore fluid (not shown to avoid confusion), sometimes referred to as a mud, within the wellbore to produce a mud pressure $P_M$ greater than the reservoir pressure $P_R$ to create an overbalanced condition and prevent formation fluid 140 from entering the wellbore. As described herein above, because $P_M$ is greater than $P_R$, some of the mud enters the formation creating both a mud cake (solids from the mud) on the borehole wall 135 and a zone of formation fluid that is contaminated with the filtrate (fluid from the mud), also known as invaded fluid, in the formation 106 adjacent to the borehole wall.

In operation, the formation testing tool 102 is lowered by wireline (22 in FIG. 1) to a nominal predetermined depth 130. As is known in the art, the clamping mechanism 162 and probe assembly 160 are urged against the borehole wall 135, and the probe 165 penetrate at least partially into the formation 106. A small piston pump driven pretest module 182 draws a sample to confirm the seal is made and determine the initial reservoir pressure $P_F$ and permeability using well-known techniques. With probe valve 312, sample valve 405 and circulation valve 303 appropriately positioned, main pump 180 draws fluid through the snorkel 165, into reservoir flowline 181, and circulates at least some of the fluid back into the wellbore 105 via flow line 185. During this cleaning process fluid is pumped through probe 165 for a sufficient period of time to remove most, if not all, of the invaded fluid in the testing volume 187 near the probe 165 to obtain formation fluid 140. Using well-known techniques, testing module 183 provides real time data to operators to assist in determining when the formation tester is producing filtrate free formation fluid 140. Such testing modules may include, pressure sensors, optical analyzers, density analyzers, NMR, Sigma Neutron as disclosed in co-pending application WO2017015340, the disclosure of which is incorporated herein in its entirety, and other such known testing modules. In prior art sampling devices, the sample receptacles are placed downstream of main pump 180, and due to the effects on the fluid of passing through the pump, an additional testing module (not shown) is typically required to verify the sample quality after exiting the pump and prior to entering the sample receptacle. The second testing module adds expense and complexity to the prior art tools. In the embodiment shown, once the formation fluids 140 are being produced in a single phase and free of invaded fluid from the testing volume 187 of the formation 106 they are ready to be sampled.

Still referring to FIG. 2, the present disclosure includes a sampling module 400 which includes sample line 401, sample fluid receptacle (or bottle) 402, sampling pump 403, sampling valve 405 and buffer fluid tank 404. In accordance with the present invention, it is advantageously possible to position the sampling module 400 in close proximity to the probe 165. With the sample module 400 and the sample receptacle 402 positioned close to the probe 165, many of the prior art problems are eliminated including minimizing the time that the sample is in line 181 and elsewhere, including sample line 401, to reduce stratification and reaction of the formation fluid 140 with the flow lines and minimizing pressure drops caused by long flow lines. In certain embodiments, buffer fluid tank 404 may be exposed to $P_M$ to facilitate the operation of sample receptacle 402 as will be more fully described herein after.

Referring to FIGS. 3-7, an embodiment of the present disclosure sample receptacle 402 having three variable volume chambers will be described in greater detail. In one such embodiment sample receptacle 402 may comprise the type of pump disclosed in co-pending Patent Cooperation Treaty application number PCT/US2018/030068, the disclosure of which is included herein in its entirety. The nomenclature and relationships in the following Table 1 is useful in interpreting the operational steps and methods associated with the present invention as will be more fully disclosed herein after.

TABLE 1

| | Volumes | | | Pressures | | |
|---|---|---|---|---|---|---|
| Step | Buffer | Nitrogen | Sample | Buffer | Nitrogen | Sample |
| 0 Preparation | $V_{B0}$, bal. | $V_{N0}$ | 0 | 0 | $P_{N0}$ | 0 |
| 1 Prefill | $V_{B1}$, bal. | $V_{N1}$ | 0 | $P_1 = P_R - P_{drawdown}$ | | |
| 2 Filled | 0 | $V_{N1}$ | $V_{S2}$, bal. | $P_1$ | | |
| 3 Pressurize | $V_{B3}$, bal. | $V_{N3}$ | $V_{S3}$ | $P_3 = P_1 + \Delta P$ | | |
| 4 Surface | $V_{B4}$, bal. | $V_{N4}$ | $V_{S4}$ | $P_4$ | | |

In Table 1, because the total volume of the bottle is fixed, the notation "bal." is that volume remaining in the receptacle after subtracting the volume of the other two fluid components. It will be readily understood by one practiced in the art that piston seal friction requires a small pressure difference to overcome the friction, but it may be ignored herein without departing from the scope of the invention. Similarly, zero pressure is an approximation to atmospheric pressure. Now, with reference to Table 1 and to FIG. 3, there is shown an embodiment of receptacle 402 after initially being prepared at the surface at Step 0. Receptacle 402 includes a hollow housing 410, which in certain embodiments is cylindrical in shape, and includes a wall 411 and end caps 412, 413. Positioned within housing 410 are a pair of pistons 414, 415 arranged to seal against the inner surface of wall 411 and are further permitted to slide in the axial direction of housing 410. Pistons 414, 415 include holes 417, 418, respectably, which accommodate limit bar 416 disposed in a slidable sealing arrangement therein, and in this particular embodiment, further include shoulder slots 419, 420 which cooperate with shoulders 421, 422 of the limit bar to limit the axial travel of the pistons to the length of the limit bar as will be more fully described herein below. With pistons 414, 415 positioned as shown, an intermediate chamber, namely pressure chamber 423 having an initial volume of $V_{N0}$ is formed therebetween. Pressure chamber 423 is filled at the surface with nitrogen, or other suitable compressible composition including other noble gases such as argon, as will be more fully described herein below, to a predetermined pressure $P_{N0}$ and pistons 414, 415 are urged apart by the pressure and against shoulders 419, 420. The nitrogen in chamber 423 provides a compressible cushion against which the pressures of the sample and buffer fluid are maintained as will be fully described herein below. An end chamber, namely buffer chamber 424 is then filled with a suitable buffer fluid, chosen from a group of nearly incompressible fluids such as mineral oil, and piston 415 is urged against end wall 413 as shown in the figure. Buffer chamber 424 is thus formed between piston 414 and end wall 412 and has a starting volume of $V_{B0}$ and, because the pressure at the surface is atmospheric, the starting pressure is $P_{B0}=0$. In the embodiment shown, $P_{N0}$ may be less than the pressure of the buffer fluid $P_B$ and with piston 415 against end wall 413 there exists minimal "dead space" in the sample receptacle. It is important to note that the receptacle 402, as well as all of its components, must be comprised of materials and design sufficient to withstand the downhole temperatures, pressures and chemicals encountered in such an operation, and the corresponding conditions at all stages of its subsequent handling and transport when filled. Although the embodiment is shown as a rigid structure, the present invention includes any embodiment having a constant volume and multiple chambers therein divided by moveable barriers such as membranes.

Figure 3:
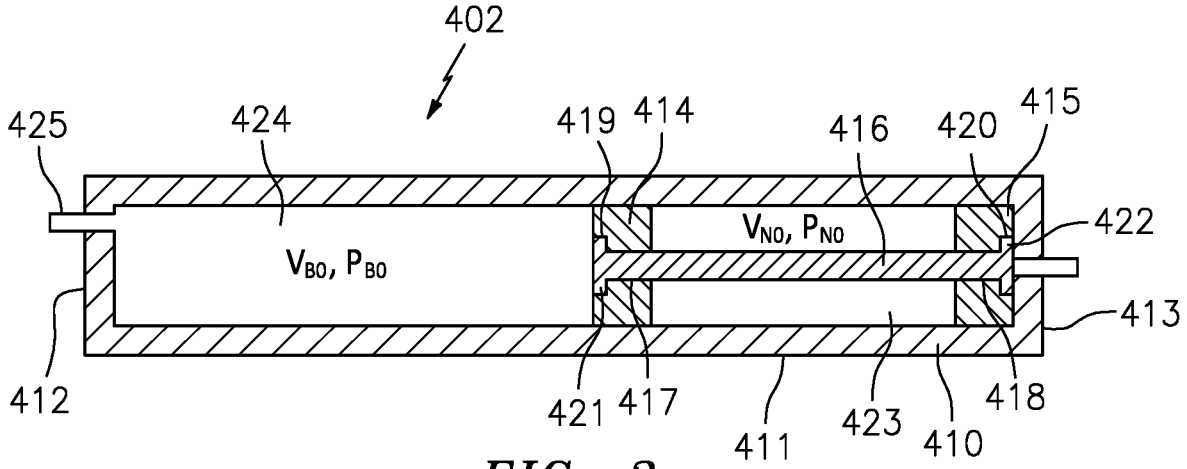
FIG. 3 is a schematic representation of an exemplary sample receptacle for obtaining samples of downhole formation fluids in accordance with certain aspects of the present disclosure.
Figure 4:
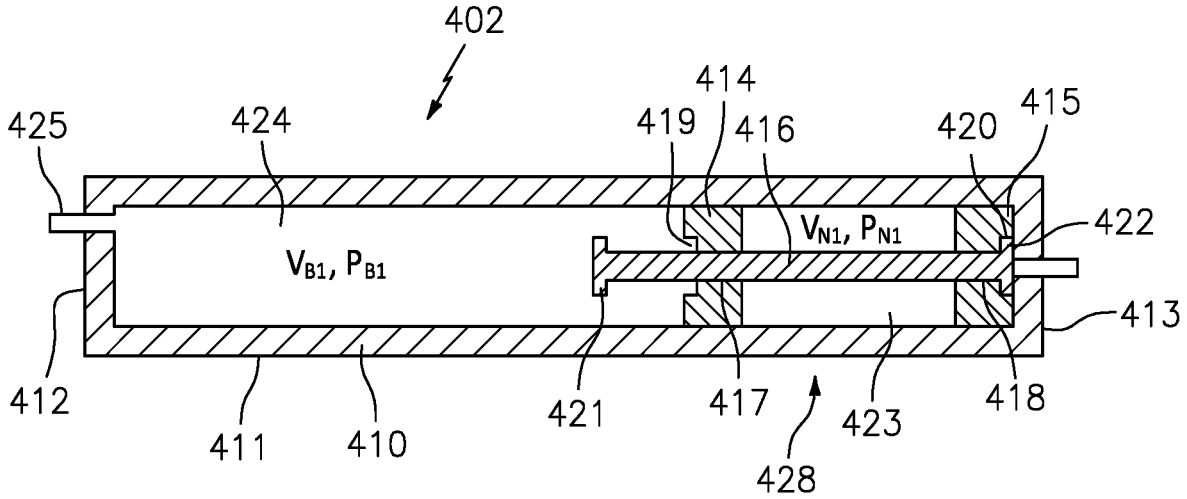
FIG. 4 is a schematic representation of an exemplary sample receptacle for obtaining samples of downhole formation fluids in accordance with certain aspects of the present disclosure.

Now referring to FIG. 4, there is shown the receptacle 402 of FIG. 3 at Step 1, of Table 1, when the receptacle is positioned within sampling module (400 of FIG. 2) while the formation tool 102 is lowered to a predetermined depth 130 in the borehole by wireline (22 in FIG. 1). As described herein before, the borehole is filled with wellbore fluid or mud, to produce a mud pressure $P_M$ greater than the reservoir pressure $P_R$, wherein $P_R$ is normally determined by the aforementioned drawdown pressure test, and wherein it is well known that $P_M$ increases with depth. In some embodiments, orifice 425 may be open to the borehole wherein $P_B$ is equal to $P_M$. In other embodiments, sample pump 403 of FIG. 2 is controlled to provide buffer fluid from buffer chamber 404 to chamber 424 through buffer orifice 425 at a pressure $P_{B1}$ approximately equal to, or greater than, $P_M$. It is important to note that when tank 404 is exposed to $P_M$ sample pump 403 may be bypassed with a hydraulic valve (not shown) or the pump only has to provide an additional pressure slightly greater than $P_M$ to position the piston-limit bar assembly 428 (comprised of pistons 414, 415 and limit bar 416) as shown in FIG. 4. Because of the increase in $P_B$, the nitrogen pressure is similarly increased to $P_{N1}$ and piston 414 is urged off shoulder 419 and traverses axially along limit bar 416. Piston 415 maintains contact with end wall 413 and the volume $V_{N1}$ of pressure chamber 423 is proportionally reduced in accordance with well-known principles.

Figure 5:
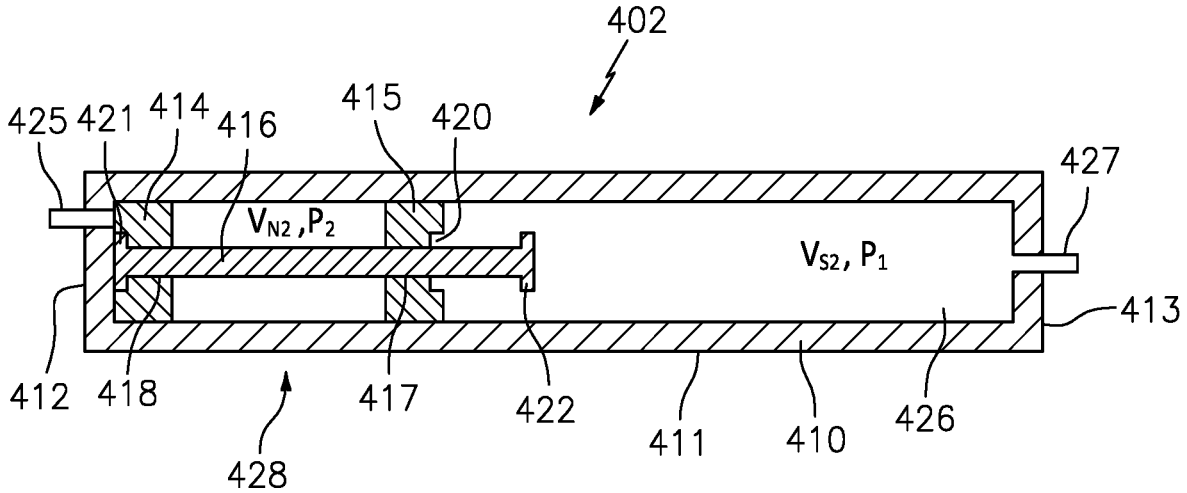
FIG. 5 is a schematic representation of an exemplary sample receptacle for obtaining samples of downhole formation fluids in accordance with certain aspects of the present disclosure.

With specific reference to FIG. 5, and general reference to FIG. 2, at Step 2 of Table 1, receptacle 402 is shown after an end chamber, namely sample chamber 426 has been filled with a sample of formation fluid 140. As should be understood by those skilled in the art, port 427 in end wall 413 may be fitted with a valve (not shown), which valve may comprise a self-actuating check valve, a motorized or hydraulically actuated valve or the like, opened to probe 165, to allow the entry of formation fluid 140. In order for formation fluid 140 to enter receptacle 402, probe valve 312, sample valve 405 main pump 180 and sample pump 403 are selectively cooperatively controlled in such a manner that the flow through probe 165 maintains a constant pressure at the probe near $P_1$ so as not to shock the formation. Embodiments of the present disclosure include those that pump formation fluids 140 from formation 106 without stopping and without interruption from the time main pump 180 begins the clean-up process through the filling process of sampling container 402, which is selectively coupled to reservoir flowline 181 by sample valve 405, by maintaining the flow rates of main pump 180 and sample pump 403 to maintain the formation at pressure $P_1$. During the filling of sample container 402, as well as subsequent sample containers, and as pumping continues, the streamlines of formation fluid 140 become longer reaching farther and farther into the formation 106 and the direction of flow does not change, i.e. it is constantly flowing toward probe 165. This directional flow at a constant rate is similar to that during the production phase of a producing well and thereby produces samples that more closely resemble that of the formation 106. Using embodiments of the present disclosure, as one or more sample containers 402 are filled, these embodiments provide for continuous and constant flow of formation fluid 140. It should be appreciated by one skilled in the art that since the flow of formation fluid 140 is continuous and constant, there is no shock to the formation 106, and there is no phase change during the time that these streamlines of formation fluid maintain direction. In so controlling the pumps, sample pump 403 withdraws buffer fluid from chamber 424 through buffer orifice 425 reducing the pressure in pressure chamber 423 below $P_{N1}$, and as the nitrogen pressure approaches $P_1$, piston 415 moves off of wall 413. Because the overall internal volume of receptacle 402 is constant, as piston 415 moves away from wall 413 the volume $V_B$ of buffer chamber 424 decreases and the volume $V_S$ of sample chamber 426 increases. Reservoir fluid 140 is drawn into sample chamber 426 though sample port 427 and exerts a pressure nearly equal to $P_1$ against piston 415. As sample pump 403 continues to draw buffer fluid out of buffer chamber 424, the syringe-like action produces a negative displace condition and causes piston-limit bar assembly 428 to move axially inside of housing 410 until piston 414 is urged against end wall 412 wherein the volume of buffer chamber 424 becomes 0, pressure chamber 423 is at $V_{N1}$, $P_1$ and sample chamber 426 is at $V_{S2}$, $P_1$. In the case where limit bar 416 touches end wall 412 first, the pistons 414, 415 will continue to slide on the limit bar until piston 414 is urged against end wall 412. It should be appreciated by those skilled in the art that the volume of buffer fluid in chamber 424 is displaced by the sample fluid 140 (FIG. 2) that is drawn into sample volume 426. Once sample chamber 426 is filled, port 427 is closed off by any known method, including the aforementioned valve, and sample pump 403 is gradually stopped while main pump 180 is increased to maintain a constant pressure at the probe 165 and a constant flow rate of formation fluid 140. With this unchanged flow rate at the probe, the formation intake pressure and reservoir fluid equilibrium is undisturbed. In addition, the negative, or non-positive, displacement, with respect to sample chamber 426, caused by the sucking action of the buffer fluid by sample pump 403 allows the sample fluid 140 to be drawn into the sample chamber without having to go through a pump as in the prior art. This is an important aspect of the present invention in that the sample fluid arrives within the sample chamber 426 with minimal changes from the condition it was in within the reservoir, i.e. it is more representative of the reservoir fluid than samples provided by sampling tools of the prior art.

Figure 6:
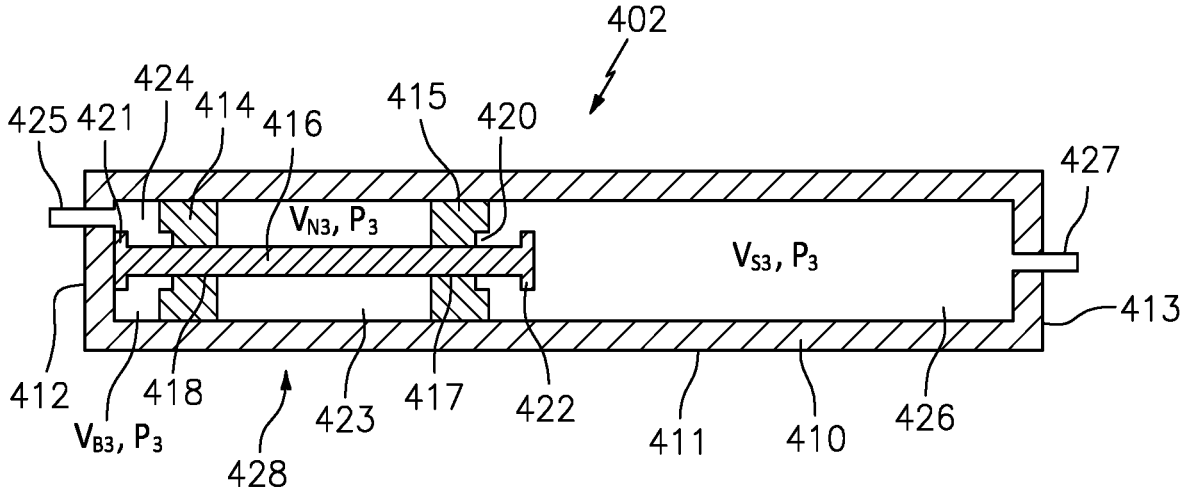
FIG. 6 is a schematic representation of an exemplary sample receptacle for obtaining samples of downhole formation fluids in accordance with certain aspects of the present disclosure.
Figure 7:
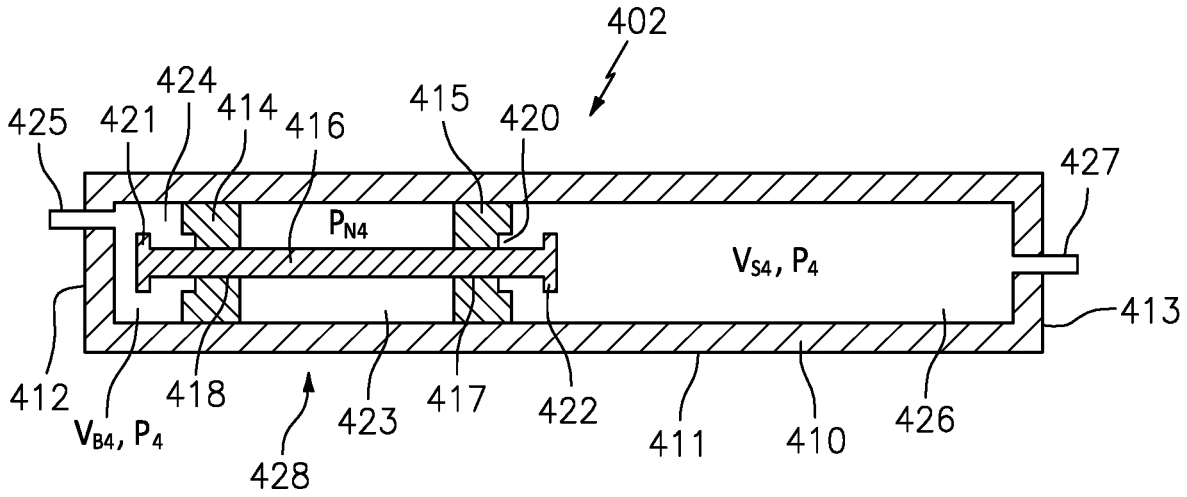
FIG. 7 is a schematic representation of an exemplary sample receptacle for obtaining samples of downhole formation fluids in accordance with certain aspects of the present disclosure.

As described herein before, it is an important aspect of the present disclosure to constantly maintain $P_S$ above the predicted bubble point of the reservoir fluid where the sample was taken. Referring to FIG. 6, and in accordance with the present disclosure, an over pressure procedure, Step 3 of Table 1, is undertaken whereby buffer fluid is added through port 425 by sample pump 403 into buffer chamber 424 in a sufficient quantity and pressure to reduce the volume of pressure chamber 423 to $V_{N3}$ and increase the pressure thereby to $P_3$. Because the sample fluid 140 in sample chamber 423 may be compressible due to dissolved gas in the fluid, the volume of the sample chamber after over pressure $V_{S3}$ may be somewhat smaller than when the sample was at $P_1$. Also, since the buffer fluid is also chosen from a group of nearly incompressible fluids, piston 414 is urged off shoulder 421 during the over pressure procedure creating volume $V_{B3}$ in buffer chamber 424. As the pressure increases to $P_3$, piston 415 will pressurize the sample and may also travel a little in the direction of the sample until pressures in buffer chamber 424, pressure chamber 423 and sample chamber 423 are in balance. The volume of the pressure chamber 423 reduces as the pressure increases. The final pressure $P_3$ of sample, nitrogen and buffer fluid (ignoring seal frictions as herein above mentioned) exceeds $P_1$ and is chosen to provide sufficient pressure $P_S$ within sample chamber 423 when the sample is brought to the surface to maintain $P_S$ above the bubble point. Where possible, the embodiment design and pressures are such that $P_S$ will always be above $P_1$. $P_1$ is known to be above bubble point since it is the sampling pressure, and the fluid at this pressure is carefully monitored for gas-breakout during pumping as herein before described.

Upon completion of the sample filling of Step 2 and over pressure procedures of Step 3 described directly herein above, formation tool 102 may be raised back to the surface by a wireline (22 in FIG. 1). As will be understood by those skilled in the art, when the sample receptacle(s) 402 are raised to the surface, the ambient temperature and pressure conditions outside of the receptacle are lower than existed at the testing depth 130. The temperature difference between the surface elevation and the testing elevation can exceed several hundred degrees Fahrenheit. As formation tool 102 is retrieved, the sample chamber 426 temperature drops, causing the sample volume, and to a lesser extent the buffer fluid volume, to reduce by well known principles and so causing $P_S$ to drop. If allowed to go unchecked, as in many sample containers of the prior art, this substantial pressure drop in the sample chamber can result in $P_S$ dropping below the bubble point, resulting in a multi-phase sample. In accordance with the present disclosure, the ambient pressure at the surface has no effect on the chambers 423, 424, 426 because the housing is sealed from the atmosphere. Because the temperature at the surface is lower, and the volume of buffer chamber 424 and sample chamber 426 are reduce to $V_{B4}$ and $V_{S4}$ respectively, the volume of pressure chamber 423 will increased proportionally to $V_{N4}$ and its pressure $P_4$ will be less than $P_3$. It should be appreciated by those skilled in the art that the combination of the preselected $P_{N0}$ and over pressure condition $P_3$ ensure that $P_4$ is maintained in sample chamber 426, and the sample fluid 140 therein, above the bubble point pressure at all times during the sampling, retrieval and transporting processes.

After sample container(s) 402 is filled and over pressurized as described directly herein above, and the drawdown is complete, the flow of formation fluid 140 is interrupted and a transient pressure buildup occurs in the formation. For analysis, and since times are recorded during the pumping, a volumetric flow rate can be determined by computing the total volume of the flow lines 181, 401, snorkel 165, and sample volume $V_{S2}$ in the one or more sample containers 402 that are filled and dividing that total volume by the time that the drawdown commenced and was ended. It should be appreciated by those skilled in the art that this is an important piece of information in determining the producibility of the formation 106 at the stated depth of the well 130. The producibility of the formation 106 can now accurately be determined using the calculated volumetric flow rate together with other data obtained from the aforementioned sensors along the flow lines 180 and probe 165 in the tool.

It is a further aspect of the present invention that a pressure gauge (not shown) may be added to port 425 to directly monitor the pressure of the buffer fluid or port 427 to monitor the pressure of the sample directly thereby as will be more fully explained herein below. It should be recognized by one skilled in the art that such an arrangement is advantageous in logging the pressure of the sample during transportation and maintaining the chain of custody of the sample. Such a pressure gauge may be any suitable type such as a MEMS pressure gauge.

It should also be appreciated by those skilled in the art that although embodiments of the present disclosure are show with a limit bar as a tension member between the piston pair, any suitable tension member such as a chain, cable, carbon fiber and the like may be substituted without departing from the scope of the present invention.

It should further be appreciated by those skilled in the art that sample receptacle 402 of the present invention delivers a more representative sample of the formation fluid than that of the prior art and includes many advantages over the prior art such as the sample fluid does not pass through a pump. The fact that the formation fluid does not pass through a pump, as in the prior art, prior to entering the sample receptacle 402 means that there is no scavenging of $H_2S$, no pressure disturbances caused by valves in which gas can break out, no residence time in pump cylinders that permits segregation (leading to the taking of samples unrepresentative of the formation), no contamination with residual fluids taken at other stations, and that only one set of monitoring equipment is required. The fact that the sample chamber may be filled using a negative displacement method leads to the sample being taken at sensibly constant sampling pressure further ensuring the consistency of sample quality and its representativeness of the fluid in the reservoir.

Many tools of the prior art use a main pump 180 of positive displacement piston pump type. In an embodiment of the present disclosure main pump 180 may comprise the type of pump disclosed in co-pending United States application number U.S. Ser. No. 16/426,677, the disclosure of which is included herein in its entirety. The pistons reciprocate and at their change of direction causing short periods of flow interruption to occur. Embodiments of the present disclosure may improve upon this by using the sampling pump 403 to maintain constant flow during sampling as described herein above. Where this arrangement may be insufficient, it is also possible to select the displacement volume of the main pump 180 to be greater than the sample volume $V_{S2}$ and coordinate the timing of the piston strokes so that the sample is taken within one stroke. Alternatively, main pump 180 may be of a progressive cavity type, which is valveless and non-reciprocating, resulting in a continuous smooth flow rate of formation fluid 140. Progressive cavity pumps have a low pressure head rating relative to their length, so their use is practically limited to lower reservoir drawdown pressure applications, of which sampling from a straddle packer is one. A further alternative pump type may be a multi-piston swash-plate pump type, which maintains a more continuous flow considering the overlapping action of the pistons eliminates interruptions in the flow. This is practically limited to smaller pumps and is the preferred type for sample pump 403

Figure 8:
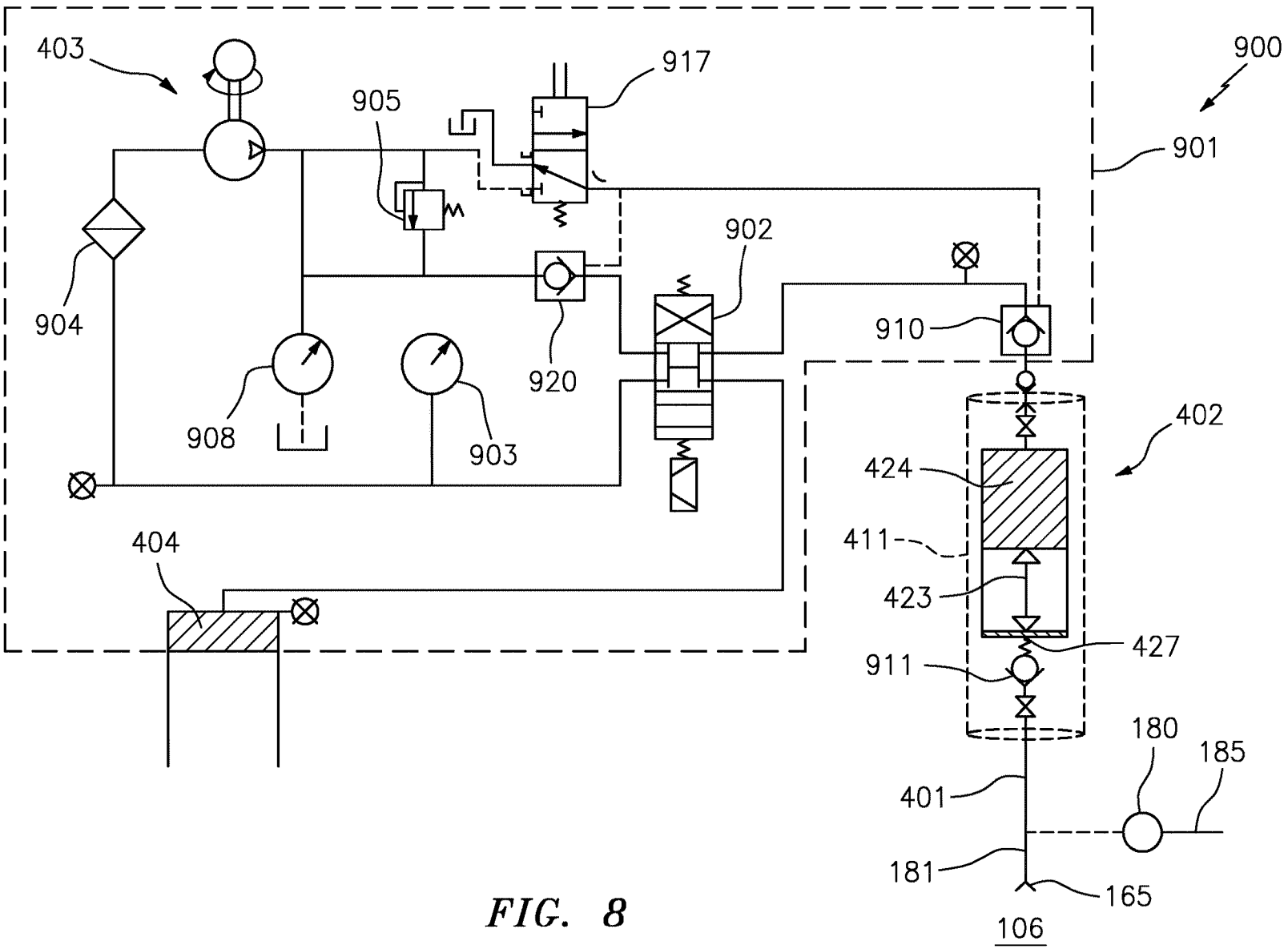
FIG. 8 is a hydraulic diagram of a system for obtaining samples of downhole formation fluids in accordance with certain aspects of the present disclosure.

Referring now to FIG. 8, there is shown a hydraulic circuit 900 associated with an embodiment of the present disclosure. FIG. 8 illustrates receptacle 402 during the initial preparation stage, at Step 0 of Table 1, and corresponding FIG. 3, where like numerals indicate like components. Hydraulic circuit 900 includes buffer fluid control circuit 901 which comprises buffer oil tank 404, isolation valve 902, pressure gauge 903, filter 904, sample pump 403, relief valve 905, electronically controlled valve 906, check valve 907 and a second pressure gauge 908. Hydraulic control circuit further includes means for actuating piloted check valve 910, shown as closed in this figure, to control fluid communication between buffer fluid chamber 424 and buffer buffer fluid tank 404 as will explained more fully herein below. Also shown in the figure is sample check valve 911, shown in the closed position, disposed between sample orifice 427 and probe assembly 165 to control reservoir fluid communication there between. In this embodiment, isolation valve 902 is closed, as well as check valves 910 and 911, which maintains the closed volume of receptacle 402 at a balanced condition from the initial preparation stage at the surface as it is lowered into the well to a predetermined depth 130 to prefill Step 1, just prior to filling the sample chamber.

Figure 9:
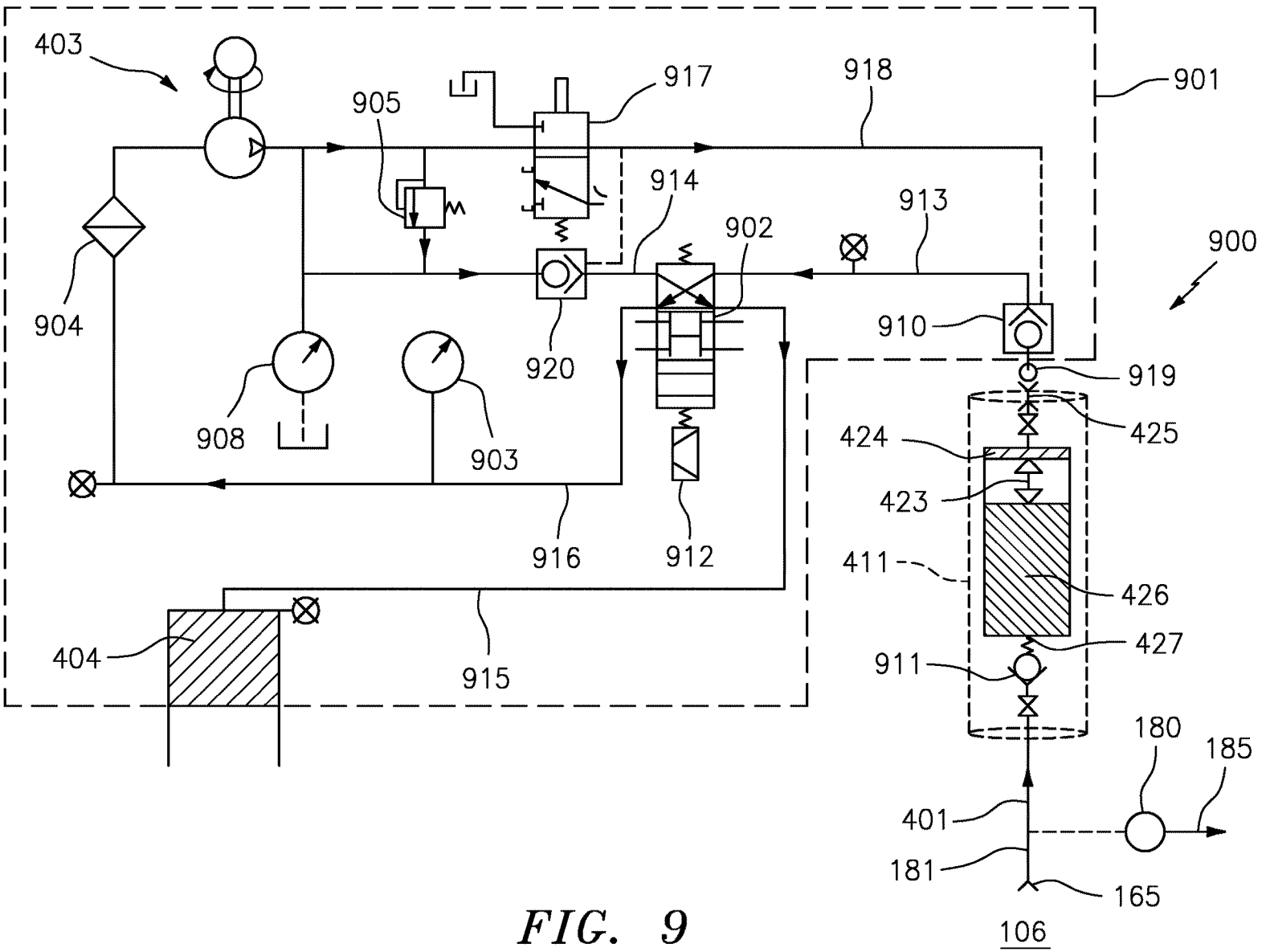
FIG. 9 is a hydraulic diagram of a system for obtaining samples of downhole formation fluids in accordance with certain aspects of the present disclosure.

FIG. 9 shows hydraulic circuit 900 during the filling of the sample chamber 426. During sample filling operations, actuator 912 of buffer fluid control circuit 901 positions servo valve 902 as shown to establish fluid communication between flow line 913 and flow line 916 and to further establish fluid communication between flow line 914 and flow line 915. Isolation valve 917 is energized and sample pump 403 pumps buffer fluid through flow line 918 to open piloted check valve 910 and piloted check valve 920 as shown. Orifice 425 is connected to check valve 919 which check valve is shown in the figure as open. As described herein above, sample pump 403 is controlled in conjunction with main pump 180 to maintain the reservoir at $P_1$ so as to not shock the reservoir. As buffer fluid is pumped from buffer fluid chamber 424 it travels into flow line 913 and makes its way through hydraulic circuit 900 and into buffer buffer fluid tank 404 as shown by the directional arrows in the figure. As described herein above with reference to FIG. 5, as the buffer fluid is withdrawn from buffer fluid chamber 424 there is a negative displacement created within receptacle 402, creating sample chamber 426, which draws reservoir fluid into the sample chamber through sample flow line 401, check valve 911 and orifice 427. The remainder of the reservoir fluid in reservoir fluid line 181, that which is not drawn into sample container 411, passes through main pump 180 and circulates back into the wellbore 106 via flow line 185.

Figure 10:
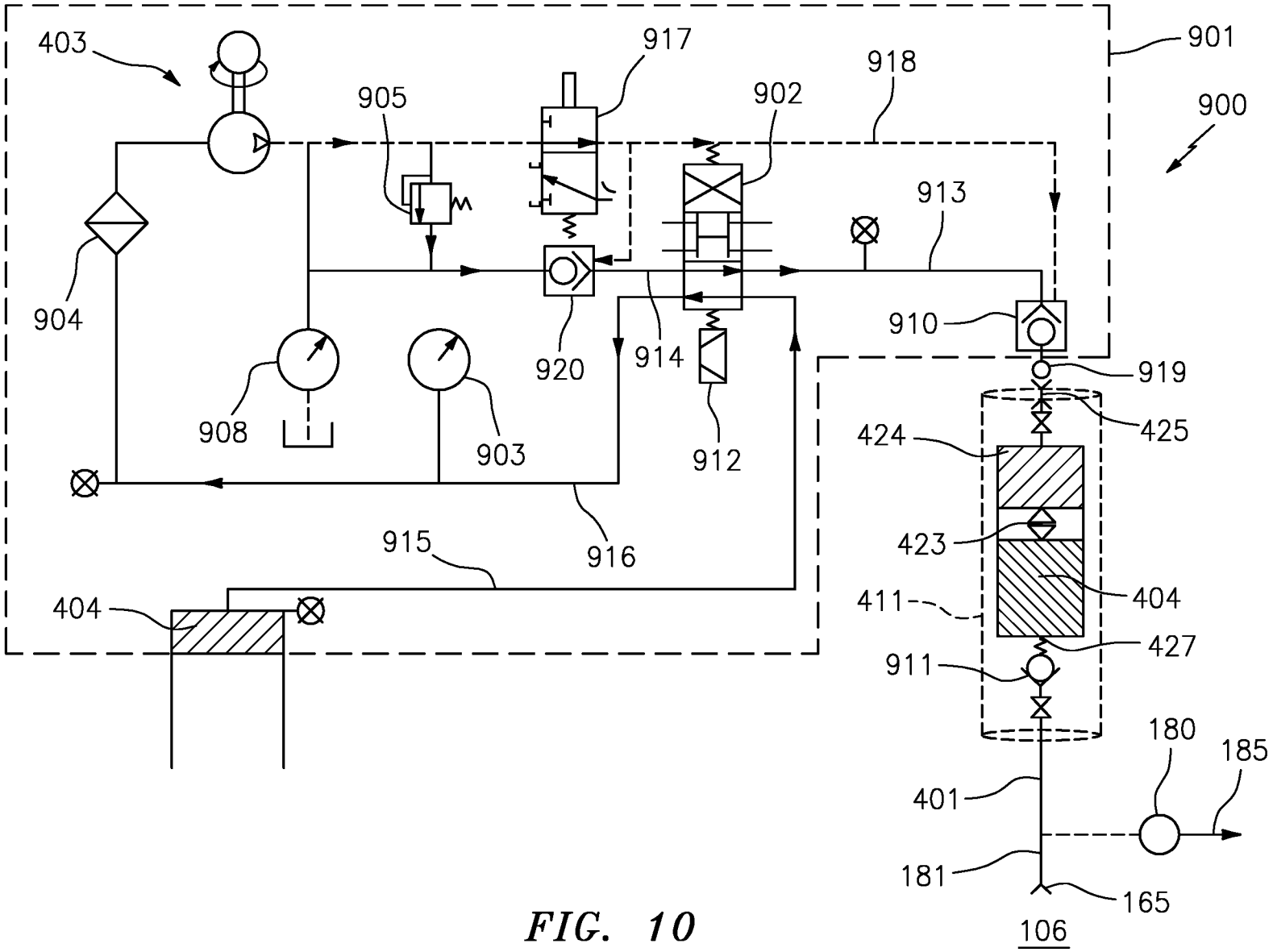
FIG. 10 is a hydraulic diagram of a system for obtaining samples of downhole formation fluids in accordance with certain aspects of the present disclosure.

FIG. 10 shows hydraulic circuit 900 during the overcharging, or pressurization, stage of Step 3. During overcharging operations, actuator 912 of buffer fluid control circuit 901 positions servo valve 902 as shown to establish buffer fluid communication between flow line 914 and flow line 913 and to further establish fluid communication between flow line 915 and flow line 916. Isolation valve 917 is energized and sample pump 403 pumps buffer fluid through flow line 918 to open piloted check valves 910, 920 as shown. Check valve 919 is also closed during the overcharge operation. Check valve 911 is closed and no reservoir fluid flows into, or out of, sample flow line 401 and the reservoir fluid in reservoir fluid line 181 passes through main pump 180 and circulates the fluid back into the wellbore 106 via flow line 185. Sample pump 403 draws buffer fluid from buffer fluid tank 404 via flow lines 915, 916 and pumps the fluid into chamber 424 via flow lines 914, 913 through piloted valve 910 and check valve 919 as shown by the directional arrows in the figure. As described herein above with reference to FIG. 6, buffer fluid is added to chamber 424 in a sufficient quantity and pressure to maintain sample chamber 404 at a pressure above the bubble point pressure of the sample. Once the desired overcharge pressure $P_3$ is achieved, the components of the hydraulic circuit are returned to the states and positions shown in FIG. 8. Another receptacle 402 may be placed between piloted check valve 910 and sample flow line 401 and another sample may be taken at the same predetermined depth 130 or at another location within the borehole in the same manner described herein above.

Figure 11:
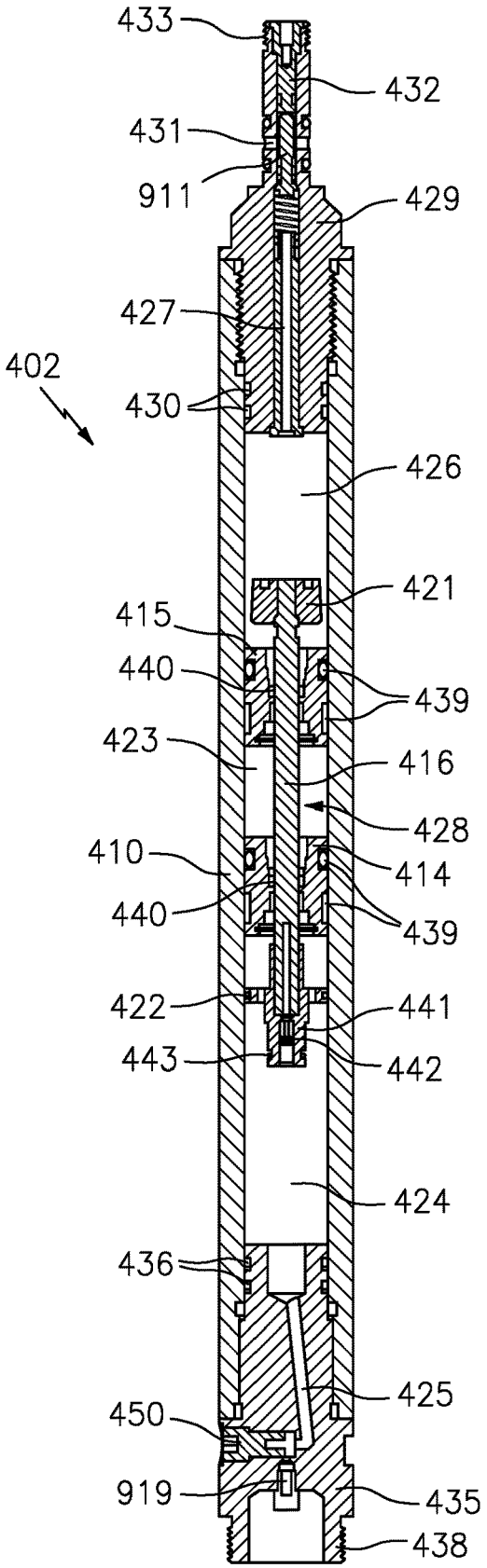
FIG. 11 is a section view of an exemplary sample receptacle for obtaining samples of downhole formation fluids in accordance with certain aspects of the present disclosure.

An embodiment of a sample receptacle 402 in accordance with the present invention is best shown with reference to FIG. 11. Sample inlet orifice 427 is disposed within sample inlet housing 429 which threaded into housing 410 and further includes seals 430 which may comprise o-rings to isolate the pressure within chamber 426 described herein above. Spring loaded check valve 911 is disposed within sample inlet orifice 427 and works to block sample inlet 431 from fluid communication with sample flow line 401 (FIG. 2) except during the sample filling operation described herein before with reference to FIG. 9. Also included in sample inlet housing 427 is sample check valve opening jack 432 screwed therein. It should be appreciated that sample check valve opening jack 432 allows for the manual opening of check valve 911 to access the sample fluid within sample chamber 426. Sample inlet housing 427 further includes screw threads 433 at its proximal end to engage with other devices such as a pressure gage (not shown) to interact with sample check valve opening jack 432 to enable a user at the surface to determine the pressure within sample chamber 426.

Still referring to FIG. 11 buffer inlet housing 435 is threadably engaged within housing 410 on an end opposite of sample inlet housing 427 and it further includes seals 436 which may comprise o-rings to isolate the pressure within buffer fluid chamber 424 described herein above. Buffer inlet housing 435 further includes buffer orifice 425 which is in fluid communication with buffer oil inlet valve 919 and also includes screw threads 438 to engage with piloted check valve 910 (FIGS. 8-10). Also included in this particular embodiment of the present invention is buffer oil axial force shutoff valve 439 which is used for locking buffer oil inlet valve 919 while at the surface.

Still referring to FIG. 11 piston limit bar assembly 428 is shown disposed within housing 410 and includes limit bar 416 having shoulders 421, 422 disposed on either end wherein shoulder 422 is integral with nitrogen fill adapter 441 which will be more fully described herein below. Pistons 414, 415 are also positioned within housing 410 on limit bar 416 between shoulders 421, 422 forming pressure chamber 423 therebetween. Pistons 421, 422 further include a set of outer seals 439 and inner seals 440 to both allow the pistons to slide within the housing and along the limit bar and to isolate the pressure within pressure chamber 428 as described herein above. Nitrogen fill adapter 441 includes nitrogen fill check valve 442 for filling pressure chamber 423 at the surface as will be explained more fully herein below.

It is an important aspect of the present disclosure that pressure chamber 423 is filled with a sufficient amount of nitrogen at the surface to maintain the sample above its bubble point pressure at all times. In the embodiment of the present disclosure shown in FIG. 11, the predetermined initial pressure of the nitrogen $P_{N0}$ may be several thousand psi. The piston limit bar assembly 428 must be disposed within housing 410 before chamber 423 can be filled with nitrogen. With piston limit bar assembly 428 disposed within housing 410 as shown, and buffer inlet housing 435 removed, a nitrogen source (not shown) is readily attached to screw threads 443 of nitrogen fill adapter 441. The nitrogen is introduced through nitrogen check valve 442 and through piston 414 into pressure chamber 423 until $P_{N0}$ is reached forcing pistons 414, 415 onto their respective shoulders 422, 421. The nitrogen source is then unscrewed and buffer inlet housing 435 is screwed into housing 410. With piston limit bar assembly 428 positioned with shoulder 422 against buffer inlet housing 435, and eliminating any volume there between, a buffer fluid source (not shown) is then threaded onto screw threads 438. With sample check valve 911 open, buffer fluid is introduced through buffer inlet housing 435 to fill buffer fluid chamber 424 to a pressure $P_{B0}$ at or slightly below $P_{N0}$ as depicted in the initial condition of Step 0 shown in FIG. 3. Buffer oil axial force shutoff valve 439 is then closed to maintain buffer oil chamber 424 at $P_{BO}$.

Figure 12A:
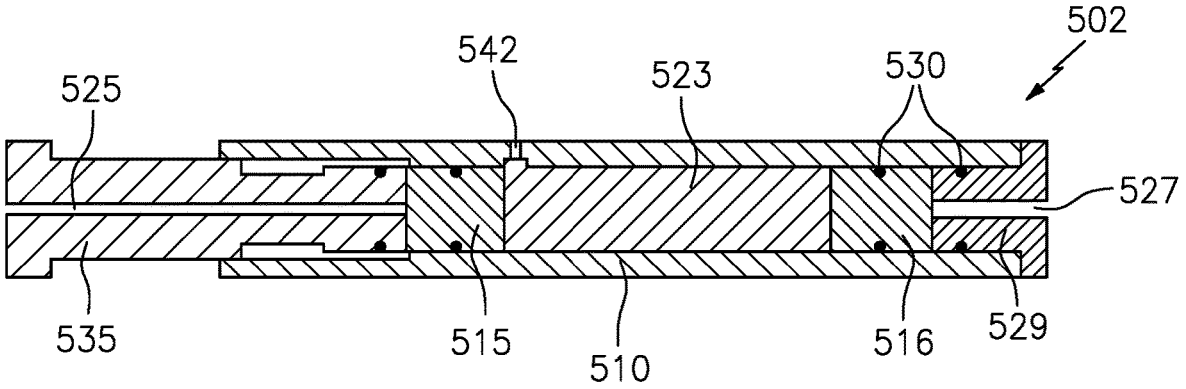
FIG. 12*a* is a section view of an embodiment of a testing fluid vessel and pressurizing tool in accordance with certain aspects of the present disclosure.
Figure 12B:
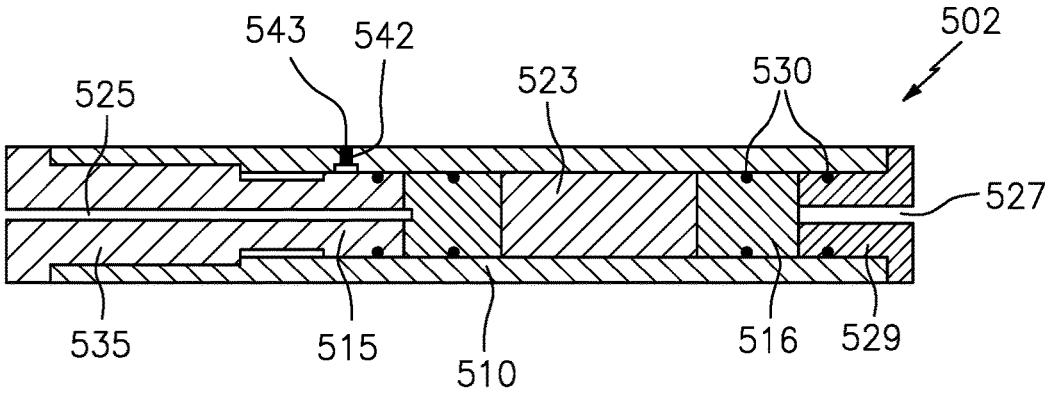
FIG. 12*b* is a section view of an embodiment of a testing fluid vessel and pressurizing tool in accordance with certain aspects of the present disclosure.

Another embodiment of a sample receptacle 502 in accordance with the present invention is best shown with reference to FIGS. 12*a* and 12*b*. In this particular embodiment there is no limit bar connecting pistons 515 and 516 and further there are no openings, holes, valves or otherwise, in either of the pistons. This important aspect of the present invention greatly simplifies the pistons and eliminates complicated valve arrangements either in the limit bar as described herein above or in the pistons themselves as disclosed in the '664 and '672 patents of the prior art discussed herein above. In the embodiment shown in FIG. 12*a*, sample inlet orifice 527 is disposed within sample inlet housing 529 which is disposed in housing 510. The sample inlet housing 529, pistons 515, 516 and buffer bulkhead 535 include seals 530 which may comprise o-rings to isolate the pressure within the chambers described herein above with reference to FIG. 11. In the embodiment shown in FIG. 12*a*, the buffer piston 516 is inserted into housing 510 and is positioned against sample inlet housing 529. Sample piston 515 is partially disposed within housing 510 and sample inlet bulkhead 535 is partially inserted into housing 510 and axially secured preferably by the engagement of threads (not shown). Pressure chamber 523 is then filled with a suitable pressurization medium, such as $N_2$, through pressurization port 542 disposed in the wall of housing 510. Pressure chamber 523 is filled to a predetermined pressure and pressurization port 542 is sealed off using a plug 543 (FIG. 12*b*). For instance, if the total volume between pistons 515, 516 is 900 cc the initial fill pressure of the $N_2$ may be 2000 psi. At P1=6000 psi, the volume of $N_2$ will be approximately 300 cc leaving 600 cc for the sample. Once pressure chamber 523 is filled, bulkhead 535 is fully installed within housing 510 as shown in FIG. 12*b*. Buffer port 542 is filled with a fluid, such as a buffer fluid or wellbore fluid, and controls the flow of sample fluid through sample orifice 527 in a similar manner to the embodiments described herein above.

Figure 13:
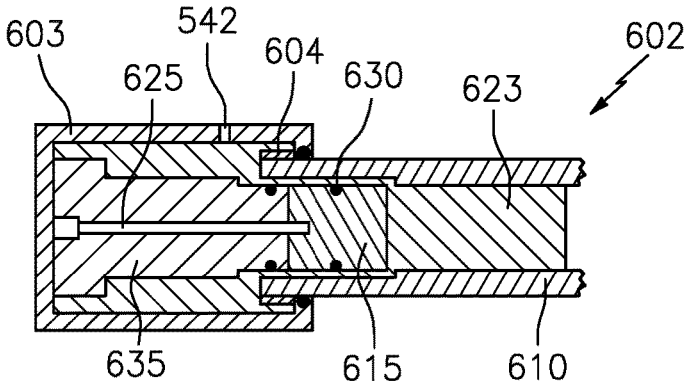
FIG. 13 is a section view of an embodiment of a testing fluid vessel and pressurizing tool in accordance with certain aspects of the present disclosure.

Referring now to FIG. 13, there is shown an alternative embodiment of the present disclosure for pressuring the pressure chamber 623 of sample receptacle 602. The sample inlet end of this particular embodiment may be the same as that shown in FIGS. 12*a*, 12*b* and is not shown in FIG. 13 for the sake of clarity and brevity. Sample receptacle 602 includes a pressurizing fixture 603 removable fixed to the buffer fluid end of housing 610 behind retaining ring 604. Buffer piston 615 is fixed to bulkhead 635 by screw 625 and the bulkhead is fixed to the fixture by a screw (not shown). With pressurizing fixture 603 positioned on sample receptacle 602 as shown pressurization chamber 623 is filled with a suitable pressurization medium, such as $N_2$, through pressurization port 642 disposed in the wall of pressurizing fixture 603 to a predetermined pressure. Once the desired predetermined level of pressure is receive pressurizing fixture 603 is translated axially along housing 610 by any known means (not shown) until the treads of bulkhead 635 and housing 610 start to engage. Bulkhead 635 is then screwed into housing 610 by rotating the fixture until o-rings 630 are suitably installed within the housing. Fixture 603 may then be removed from the bulkhead and screw 625 may then be removed from buffer piston 615 leaving a port in the bulkhead. The buffer port may then be filled with a fluid, such as a buffer fluid or wellbore fluid, and controls the flow of sample fluid through the sample orifice in a similar manner to the embodiments described herein above.

While the foregoing is directed to only certain embodiments of the present disclosure certain observations of the breadth of the present disclosure should be made. Wireline, as referred to herein, may be electric wireline including telemetry and power. Wireline may also include wired slickline and wired coil tubing. Embodiments of the present disclosure include pumped-down-the-drill-pipe formation testing where the tools described herein exit through the drill bit. Otherwise heretofore conventional LWD that include the present disclosure allow for formation testing and sampling where the drill pipe may be wired for power and telemetry or some other telemetry such as mud pulse or electromagnetic through the earth. Embodiments of the present disclosure further include probe mounted sampling tools as well as straddle packer types and their use in open hole and cased hole wells. Further, commands and data can be stored using battery power, and power can come from a turbine during circulation. Other and further embodiments of the disclosure may be devised without departing from the basic scope thereof, and the scope thereof is determined by the claims that follow.

What is claimed is:

1. A tool configured to sample a formation fluid from a reservoir comprising:

a reservoir flowline configured to be in fluid communication with a portion of the reservoir;

a main pump in fluid communication with the reservoir flowline;

a sample container in fluid communication with the reservoir flowline;

a sampling pump hydraulically coupled to the sample container and configured to transfer a buffer fluid in and out of the sample container; and a power and processing unit configured to control the main pump and the sampling pump to maintain the reservoir approximately at a drawdown pressure.

2. The tool of claim 1, wherein the sample container comprises:

a housing having at least two pistons slidably disposed therein and dividing the housing into at least three chambers, each of the at least three chambers having a variable volume, including an intermediate chamber, a first end chamber and a second end chamber, the intermediate chamber defined by the pistons and wherein the pistons are free of valves;

a first conduit configured to pressurize the intermediate chamber with a gas;

a second conduit coupled to the first end chamber and the reservoir flowline; and a third conduit coupled to the second end chamber and the sampling pump.

3. The tool of claim 2, further comprising a packer, the packer comprised of one of a donut packer and a straddle packer.

4. The tool of claim 2 further comprising a probe assembly, the probe assembly comprising:

a snorkel coupled to the reservoir flowline and configured to penetrate at least partially into the portion of the reservoir.

5. The tool of claim 2, further comprising a buffer fluid tank coupled to the sampling pump.

6. The tool of claim 2, wherein the gas comprises a noble gas.

7. The tool of claim 1, wherein the buffer fluid comprises a nearly incompressible fluid.

8. The tool of claim 1, wherein the sampling pump comprises a multi-piston swash-plate pump.

9. The tool of claim 1, wherein the main pump comprises one of a positive displacement piston pump and a progressive cavity pump.

10. The tool of claim 1, further comprising a sample valve to selectively couple the sample container in fluid communication with the reservoir flowline.

11. A method of sampling a formation fluid from a reservoir comprising:

positioning a reservoir flowline in fluid communication with a portion of the reservoir located below a surface;

coupling a main pump to the reservoir flowline;

coupling a sample container to the reservoir flowline and to a sampling pump, the sample container having a buffer chamber and a sample chamber;

pumping the formation fluid continuously with the main pump until the formation fluid is substantially free of filtrate;

splitting the formation fluid into a first portion and a second portion;

pumping the first portion with the main pump;

pumping a buffer fluid out of the buffer chamber with the sample pump; and drawing the second portion of the formation fluid into the sample chamber.

12. The method of claim 11 further comprising continuously controlling the main pump and the sample pump to maintain the reservoir approximately at a reservoir drawdown pressure.

13. The method of claim 12 wherein the sample container further comprises a pressure chamber positioned between the buffer chamber and the sample chamber, the method further comprising pressurizing the pressure chamber to a predetermined initial pressure.

14. The method of claim 13 further comprising sealing the second portion in the sample chamber.

15. The method of claim 14 wherein the predetermined initial pressure maintains the second portion of the formation fluid above a bubble point of the formation fluid.

16. The method of claim 15 further comprising pumping the buffer fluid into the buffer chamber with the sample pump and creating an over pressure condition in the second portion of the formation fluid.

17. The method of claim 16 further comprising sealing the buffer fluid in the buffer chamber.

18. The method of claim 17 further comprising transporting the sample container to the surface.

19. The method of claim 14 further comprising:

continuously pumping the formation fluid with the main pump;

uncoupling the sample container from the reservoir flowline and the sampling pump; and coupling a subsequent sample container to the reservoir flowline and to the sampling pump.

20. The method of claim 11 further comprising sealing off the portion of the reservoir.

21. A method of sampling a formation fluid from a reservoir comprising:

providing a first sample container and a second sample container each comprising:

dividing a housing into at least three chambers, each of the at least three chambers having a variable volume, including an intermediate chamber, a first end chamber and a second end chamber;

pressurizing the intermediate chamber with a gas;

pumping the formation fluid continuously with a main pump until the formation fluid is substantially free of filtrate;

coupling the second end chamber of the first sample container to a sampling pump;

simultaneously pumping a first portion of the formation fluid with the main pump and transferring a buffer fluid out of the second end chamber of the first sample container using the sampling pump;

drawing a second portion of the formation fluid into the first end chamber of the first sample container until the first end chamber of the first sample container is full of second portion of the formation fluid;

sealing the first end chamber of the first sample container and the second end chamber of the first sample container;

pumping the formation fluid continuously with the main pump;

uncoupling the first sample container;

coupling the second end chamber of the second sample container to the sampling pump;

simultaneously pumping a third portion of the formation fluid with the main pump and transferring the buffer fluid out of the second end chamber of the second sample container using the sampling pump;

drawing a fourth portion of the formation fluid into the first end chamber of the second sample container until the first end chamber of the second sample container is full of the fourth portion of the formation fluid; and sealing the first end chamber of the second sample container and the second end chamber of the second sample container.

22. The method of claim 21 further comprising continuously maintaining the reservoir at a reservoir drawdown pressure.

* * * * *